United States Patent [19]

Ichikawa et al.

[11] 4,340,781

[45] Jul. 20, 1982

[54] SPEECH ANALYSING DEVICE

[75] Inventors: Akira Ichikawa, Musashino; Kazuo Nakata, Kodaira; Akira Nakajima, Tokyo; Yoshihiro Ohta; Kazuhiro Umemura, both of Yokohama, all of Japan

[73] Assignee: Hitachi, Ltd., Tokyo, Japan

[21] Appl. No.: 145,148

[22] Filed: Apr. 30, 1980

[30] Foreign Application Priority Data

May 14, 1979 [JP] Japan ..... 54-63045[U]

[51] Int. Cl.³ ..... G10L 1/00

[52] U.S. Cl. ..... 179/1 SA

[58] Field of Search ..... 179/1 SA, 1 SB, 1 SM, 179/15.55 R; 364/724, 725, 728; 84/1.01

[56] References Cited

U.S. PATENT DOCUMENTS 4,052,563 10/1977 Noda et al. ..... 179/1 SA

OTHER PUBLICATIONS

Itakura et al., "Digital Filtering Techniques etc.", Seventh Int'l. Congress on Acoustics, Budapest, 1971, pp. 261–264.

Kolke et al., "Parcor Audio Response Unit", Review of Elect. Comm. Labs., May–Jun. 1975, pp. 490–501.

Esteban, et al., "Low Bitrate Predictive Voice Encoding", IBM Tech. Discl. Bull., Sep. 1976, pp. 1279–1280.

Roux, "A Fixed Point Computation of Parcor Coefficients", IEEE Trans. on Acoustics etc., Jun. 1977, pp. 257–259.

*Primary Examiner*—Mark E. Nusbaum
*Assistant Examiner*—E. S. Kemeny
*Attorney, Agent, or Firm*—Craig and Antonelli

[57] ABSTRACT

Computation of the partial correlation coefficients (PARCOR $K_i$) of a signal, using less cascaded hardware, is implemented by first deriving a sequence of auto-correlation coefficients ($v_j$) which are then transformed into a sequence of $K_i$ using a single section digital filter plus recirculating circuitry for data iteration.

3 Claims, 7 Drawing Figures

FIG. 6

| T | a | b | c | d | e | k | f | g | h | k | $S_8$ |
|---|---|---|---|---|---|---|---|---|---|---|---|
| 0 | $e^0_1$ | $e^0_1$ | | | | | | | $e^0_1$ | | 1 |
| 1 | $e^0_2$ | $e^0_2$ | | | | | | | ($S_7$ | | 1 |
| 2 | $e^0_3$ | $e^0_3$ | | | | | | | ON) | | 1 |
| 3 | $e^0_4$ | $e^0_4$ | | | | | | | | | 1 |
| 4 | $e^0_5$ | $e^0_5$ | | | | | | | | | 1 |
| 5 | $e^0_6$ | $e^0_6$ | | | | | | | | | 1 |
| 6 | $e^0_7$ | $e^0_7$ | | | | | | | | | 1 |
| 7 | $e^0_8$ | $e^0_8$ | | | | | | | | | 1 |
| 8 | $e^0_9$ | $e^0_9$ | | | | | | | | | 1 |
| 9 | $e^0_{10}$ | $e^0_{10}$ | | | | | | | | | 1 |
| 10 | $e^0_{-0}$ | $e^0_{-0}$ | | $e^0_{-0}$ | q=4 | | | | $e^0_{-0}$ | q | 2 |
| 11 | $e^0_{-1}$ | $e^0_{-1}$ | | $e^0_{-1}$ | | | | | ($S_7$ | | 2 |
| 12 | $e^0_{-2}$ | $e^0_{-2}$ | | $e^0_{-2}$ | | | | | ON) | | 2 |
| 13 | $e^0_{-3}$ | $e^0_{-3}$ | | $e^0_{-3}$ | | | | | | | 2 |
| 14 | $e^0_{-4}$ | $e^0_{-4}$ | | $e^0_{-4}$ | $e^0_{-0}$ | (*) | r=5 | | | $k_1$ | 2 |
| 15 | $e^0_{-5}$ | $e^0_{-5}$ | | $e^0_{-5}$ | $e^0_{-1}$ | $k_1$ | | | | | 2 |
| 16 | $e^0_{-6}$ | $e^0_{-6}$ | | $e^0_{-6}$ | $e^0_{-6}$ | $k_1$ | | | | | 2 |
| 17 | $e^0_{-7}$ | $e^0_{-7}$ | | $e^0_{-7}$ | $e^0_{-3}$ | $k_1$ | | | | | 2 |
| 18 | $e^0_{-8}$ | $e^0_{-8}$ | | $e^0_{-8}$ | $e^0_{-4}$ | $k_1$ | | | | | 2 |
| 19 | $e^0_{-9}$ | $e^0_{-9}$ | | $e^0_{-9}$ | $e^0_{-5}$ | $k_1$ | $(*e^0_{-0})$ | | | | 2 |
| 0 | | $(e^1_1)$ | $e^0_2$ | $e^0_1$ | $e^0_{-6}$ | $k_1$ | $k_1 e^0_{-1}$ | $(e^1_1=e^0_1-*e^0_0)$ | | | 1 |
| 1 | | $e^1_2$ | $e^0_3$ | $e^0_2$ | $e^0_{-7}$ | $k_1$ | $k_1 e^0_{-2}$ | $e^1_2=e^0_2-k_1 e^0_{-1}$ | $e^1_2$ | | 1 |
| 2 | | $e^1_3$ | $e^0_4$ | $e^0_3$ | $e^0_{-8}$ | $k_1$ | $k_1 e^0_{-3}$ | $e^1_3=e^0_3-k_1 e^0_{-2}$ | ($S_7$ | | 1 |
| 3 | | $e^1_4$ | $e^0_5$ | $e^0_4$ | $e^0_{-9}$ | $k_1$ | $k_1 e^0_{-4}$ | $e^1_4=e^0_4-k_1 e^0_{-3}$ | ON) | | 1 |
| 4 | | $e^1_5$ | $e^0_6$ | $e^0_5$ | $e^0_1$ | $k_1$ | $k_1 e^0_{-5}$ | $e^1_5=e^0_5-k_1 e^0_{-4}$ | | | 1 |
| 5 | | $e^1_6$ | $e^0_7$ | $e^0_6$ | $e^0_2$ | $k_1$ | $k_1 e^0_{-6}$ | $e^1_6=e^0_6-k_1 e^0_{-5}$ | | | 1 |
| 6 | | $e^1_7$ | $e^0_8$ | $e^0_7$ | $e^0_3$ | $k_1$ | $k_1 e^0_{-7}$ | $e^1_7=e^0_7-k_1 e^0_{-6}$ | | | 1 |
| 7 | | $e^1_8$ | $e^0_9$ | $e^0_8$ | $e^0_4$ | $k_1$ | $k_1 e^0_{-8}$ | $e^1_8=e^0_8-k_1 e^0_{-7}$ | | | 1 |
| 8 | | $e^1_9$ | $e^0_{10}$ | $e^0_9$ | $e^0_5$ | $k_1$ | $k_1 e^0_{-9}$ | $e^1_9=e^0_9-k_1 e^0_{-8}$ | | | 1 |
| 9 | | $e^1_{10}$ | $e^0_{-0}$ | $e^0_{10}$ | $e^0_6$ | $k_1$ | $k_1 e^0_1$ | $e^1_{10}=e^0_{10}-k_1 e^0_{-9}$ | | | 1 |
| 10 | | $e^1_{-0}$ | $e^0_{-1}$ | $e^1_{-0}$ | $e^0_7$ | $k_1$ | $k_1 e^0_2$ | $e^1_{-0}=e^0_{-0}-k_1 e^0_1$ | $e^1_{-0}$ | q | 2 |
| 11 | | $e^1_{-1}$ | $e^0_{-2}$ | $e^1_{-1}$ | $e^0_8$ | $k_1$ | $k_1 e^0_3$ | $e^1_{-1}=e^0_{-1}-k_1 e^0_2$ | ($S_7$ | | 2 |
| 12 | | $e^1_{-2}$ | $e^0_{-3}$ | $e^1_{-2}$ | $e^0_9$ | $k_1$ | $k_1 e^0_4$ | $e^1_{-2}=e^0_{-2}-k_1 e^0_3$ | ON) | | 2 |
| 13 | | $e^1_{-3}$ | $e^0_{-4}$ | $e^1_{-3}$ | $e^0_{10}$ | $k_1$ | $k_1 e^0_5$ | $e^1_{-3}=e^0_{-3}-k_1 e^0_4$ | | | 2 |
| 14 | | $e^1_{-4}$ | $e^0_{-5}$ | $e^1_{-4}$ | $e^1_{-0}$ | (*) | $k_1 e^0_6$ | $e^1_{-4}=e^0_{-4}-k_1 e^0_5$ | | $k_2$ | 2 |
| 15 | | $e^1_{-5}$ | $e^0_{-6}$ | $e^1_{-5}$ | $e^1_{-1}$ | $(k_2)$ | $k_1 e^0_7$ | $e^1_{-5}=e^0_{-5}-k_1 e^0_6$ | | | 2 |
| 16 | | $e^1_{-6}$ | $e^0_{-7}$ | $e^1_{-6}$ | $e^1_{-2}$ | $k_2$ | $k_1 e^0_8$ | $e^1_{-6}=e^0_{-6}-k_1 e^0_7$ | | | 2 |
| 17 | | $e^1_{-7}$ | $e^0_{-8}$ | $e^1_{-7}$ | $e^1_{-3}$ | $k_2$ | $k_1 e^0_9$ | $e^1_{-7}=e^0_{-7}-k_1 e^0_8$ | | | 2 |
| 18 | | $e^1_{-8}$ | $e^0_{-9}$ | $e^1_{-8}$ | $e^1_{-4}$ | $k_2$ | $k_1 e^0_{10}$ | $e^1_{-8}=e^0_{-8}-k_1 e^0_9$ | | | 2 |
| 19 | | $e^1_{-9}$ | $e^0_1$ | $e^1_{-9}$ | $e^1_{-5}$ | $k_2$ | $(*e^1_0)$ | $e^1_{-9}=e^0_{-9}-k_1 e^0_1$ | | | 2 |
| 0 | | $(e^2_1)$ | $e^1_2$ | $e^1_1$ | $e^1_{-6}$ | $k_2$ | $(k_2 e^1_{-1})$ | $(e^2_1=e^1_1=*e^1_0)$ | | | 1 |
| 1 | | $(e^2_2)$ | $e^1_3$ | $e^1_2$ | $e^1_{-7}$ | $k_2$ | $k_2 e^1_{-2}$ | $(e^2_2=e^1_2-k_2 e^1_{-1})$ | | | 1 |
| 2 | | $e^2_3$ | $e^1_4$ | $e^1_3$ | $e^1_{-8}$ | $k_2$ | $k_2 e^1_{-3}$ | $e^2_3=e^1_3-k_2 e^1_{-2}$ | $e^2_3$ | | 1 |
| 3 | | $e^2_4$ | $e^1_5$ | $e^1_4$ | $e^1_{-9}$ | $k_2$ | $k_2 e^1_{-4}$ | $e^2_4=e^1_4-k_2 e^1_3$ | ($S_7$ | | 1 |
| | | | | | | | | | ON) | | |

SPEECH ANALYSING DEVICE

BACKGROUND OF THE INVENTION (1) Field of the Invention

This invention relates to a speech analysing device, more particularly to an improvement in an analysing device using a "PARTIAL AUTO-CORRELATION COEFFICIENT." (Hereinafter, this coefficient will be called "PARCOR coefficient" for short and an analysing system using the coefficient, "PARCOR system.")

(2) Description of the Prior Art

About a decade has passed since Itakura and Saitoh devised the PARCOR system speech analysis (Itakura et al., REPORTS OF THE MEETING BY THE ACOUSTICAL SOCIETY OF JAPAN, 1976, October, p. 555). Since the content of this system is well known to those skilled in the art, the explanation of the system is hereby deleted.

As devices for determining the PARCOR coefficient k in this PARCOR system, there have so far been proposed a device which incorporates a mini-computer in the device to determine the coefficient k in accordance with the algorithm given by Itakura and Saitoh, a device which determines the coefficient by a lattice method using a lattice type filter and a correlator disclosed in the abovementioned report, and a device by a modified lattice method proposed by Kobayashi and Yamamoto (Yamamoto et al.; "OPERATION ACCURACY OF MODIFIED LATTICE TYPE PARCOR ANALYSING CIRCUIT," REPORTS OF THE MEETING BY THE ACOUSTICAL SOCIETY OF JAPAN, 1977, April, p. 257), and so forth.

The abovementioned lattice method and modified lattice method are suited for the adaptation to a device because they use simple algorithms, However, since the number of operational steps is large, a hardware construction having high processing capacity is required.

On the other hand, the method proposed by J. Le Roux (J. Le. Roux, "A Fixed Point Computation of Partial Correlation Coefficients," IEEE TRANSACTIONS ON ACOUSTICS SPEECH AND SIGNAL PROCESSING, 1977, June, p. 257–259) has a characterizing feature in that the number of steps to be processed is small and the operation accuracy is high. To this date, however, no method has been developed to realize the abovementioned method using simple hardware capable of processing at a high rate.

SUMMARY OF THE INVENTION

In view of the abovementioned problem, the present invention is directed to provide a device which realizes the algorithm proposed by J. Le Roux using a simple hardware construction.

To accomplish this object, the present invention uses a hardware construction consisting of a data circulation portion cascade-connected to a PARCOR coefficient computation portion, and is characterized in that the PARCOR coefficients are computated sequentially by applying a sequence of auto-correlation coefficients of input speech signals to the data circulation portion while feeding back the output of the PARCOR coefficient computation portion to the data circulation portion, and repeating this process.

BRIEF DESCRIPTION OF THE DRAWINGS

FIG. 6 is a diagram showing the flow of signals appearing at the principal portions of FIG. 5 at every clock timing.

DETAILED DESCRIPTION OF THE PREFERRED EMBODIMENTS

Figure 1:
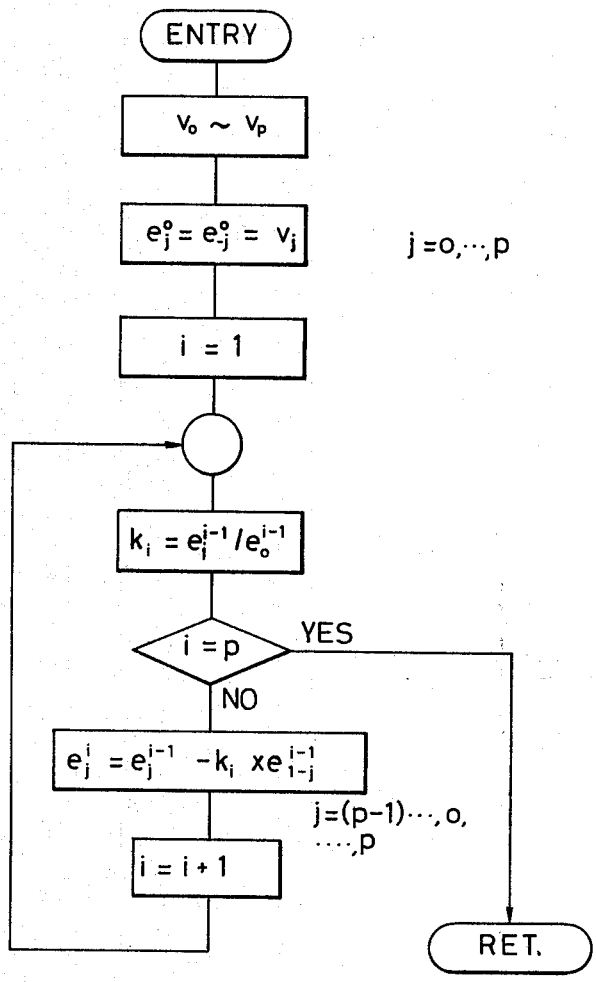
FIG. 1 is a diagram showing the procedures for obtaining the PARCOR coefficients using the present invention in accordance with the algorithm of J. Le Roux.

The procedures of the present invention to obtain the PARCOR coefficients in accordance with the method proposed by J. Le Roux are shown in FIG. 1.

First, the auto-correlation coefficients $v_0$–$v_p$ (where p is the order of the PARCOR coefficients to be determined) are first calculated, and the initial condition is set in the following manner;

$$e_{j0}=e_{-j0}=v_j\ (j=0, 1, \ldots, p) \tag{1}$$

The PARCOR coefficient $k_1, k_2, \ldots, k_p$ are sequentially obtained by solving the asymptotic equation $$k_1 = e_1^{i-1}/e_0^{i-1} \tag{2}$$

$$e_j^i = e_j^{i-1} - k_i \cdot e_{1-j}^{i-1}\ (j = -(p-1), \ldots, -1, 0, 1, \ldots, p)$$

The first embodiment of the present invention discloses a device for solving the abovementioned asymptotic equation to determine $k_1$ by repeated use of two shift registers and a one-stage lattice type digital filter. The second embodiment of the invention discloses a device for solving the asymptotic equation to determine $k_1$ by utilizing the delay of a shift register and the delay timing of a multiplier. Both of these embodiments make it possible to realize the algorithm proposed by J. Le Roux through an extremely simple hardware construction.

Figure 2:
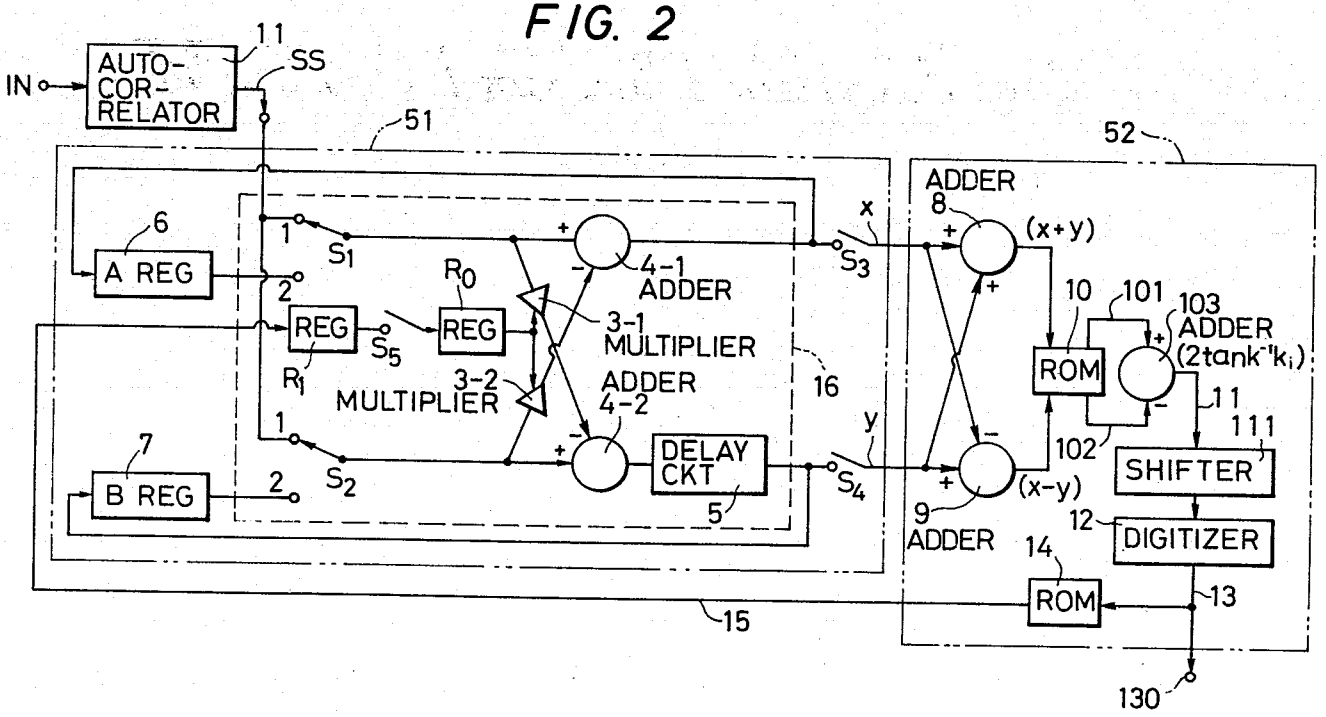
FIG. 2 is a circuit diagram of an embodiment of the speech analysing device of the present invention for carrying out the procedures of FIG. 1.

FIG. 2 shows a circuit diagram of the first embodiment of the speech analyzing device of the present invention, in which auto-correlation coefficient sequence SS ($v_0, v_1, \ldots, v_p$) is calculated by a known Auto-Correlator 11 from input speech signals IN to be analysed, and is applied to the data circulation portion 51.

A register $R_0$ of a digital filter 16 included in the data circulation portion 51 is cleared and switches $S_1$ and $S_2$ are set to the side of "1" before the operation to compute the PARCOR coefficients is started in the data circulation portion 51 and in the PARCOR coefficient computation portion 52.

The auto-correlation coefficient sequence SS ($v_o, v_1, \ldots, v_p$) input to the data circulation portion 51 is stored in a shift register 6 (hereinafter called "A-Reg") and in a shift register 7 (hereinafter called "B-Reg") through multipliers 3-1 and 3-2 (the result of multiplication is 0 because the content of $R_0$ is 0), adders 4-1 and 4-2 and a 1-data delay circuit 5.

The A-Reg and B-Reg may have such a data length (p words) as to correspond to the number of orders of the PARCOR coefficients to be determined.

For the sake of simplicity, the operation of FIG. 2 will be explained in detail in the case of $p=10$.

When switches $S_3$ and $S_4$ are turned on at the timing at which $v_1$ enters A-Reg, $v_0$ which is retarded by one-data by the delay circuit 5 enters the input of B-Reg.

Accordingly, since the output x and y of the switches $S_3$ and $S_4$ become $x=v_1=e_1^0$ and $y=v_0=e_0^0$, respectively, the output of adders 8 and 9 become $(x+y)$ and $(x-y)$, respectively, and they are sent to the PARCOR coefficient computation portion 52.

In the PARCOR coefficient computation portion 52, logarithmic contents are read from a ROM 10 using $(x+y)$ and $(x-y)$ as the addresses. The results of reading 101 and 102 are subtracted in an adder circuit 103, and the output 11 becomes as follows;

$$\log(y+x)-\log(y-x)=\log\frac{y+x}{y-x}=\log\frac{1+\frac{x}{y}}{1-\frac{x}{y}}$$

$$=\log\frac{1+\frac{e_o^o}{e_o^o}}{1-\frac{e_1^o}{e_o^o}}=\log\frac{1+k_1}{1-K_1}$$

$$=2\cdot\tanh^{-1}K_1$$

Thus, a product two times a parameter $\tan h^{-1}k_1$ called "log area ratio" is obtained.

It is known that the influence of quantization is smaller on the log area ratio than on the PARCOR coefficient k when each is quantized.

The abovementioned result is multiplied by $\frac{1}{2}$ by a shifter 111 (1-bit shift may be made) to obtain $\tan h^{-1}k_1$, which is quantized by a digitizer 12 to obtain result 13. The result 13 is produced as output at an external terminal 130. Using this result as the address, a reverse conversion table of $\tan h^{-1}k_1$ written in a ROM 14 is read out therefrom to return the log area ratio to the PARCOR coefficient $k_1$, is fed back to the data circulation portion 51 and is then stored in the register $R_1$.

Needless to say, it is naturally possible to directly obtain $k_1$ as $k_1=x/y$.

Figure 3A:
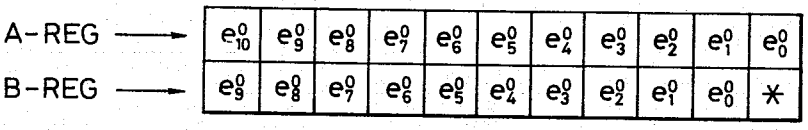
FIG. 3 is a diagram showing an example of data array stored in the A and B registers of FIG. 2.
Figure 3B:
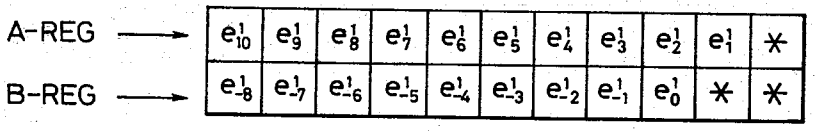

The switches $S_3$ and $S_4$ are turned off at the timing at which $v_2$ enters A-Reg. The switches $S_1$ and $S_2$ are connected to the "2" side at the timings at which $v_0$, $v_1$, . . . , $v_{10}$ are stored in A-Reg and B-Reg, the switch $S_5$ is turned on and the content of the register $R_1$ is transferred to the register $R_0$. At this time, the contents of A-Reg and B-Reg are such as shown in FIG. 3(*a*). Symbol * in the drawing represents meaningless data. Due to the delay circuit 5, data each deviated by one word from the corresponding data of A-Reg are stored in B-Reg. Next, the data are fed out one word by one from both A-Reg and B-Reg and multiplication is made by means of the output of the register $R_0$ and multipliers 3-1 and 3-2. The result of multiplication is applied to the adders 4-1 and 4-2 to operate the following equation (3) corresponding to the aforementioned equation (2);

$$\left.\begin{aligned}
e_o^1 &= e_o^o - k_1\times e_{-1}^o = v_o - k_1\times v_1\\
e_1^1 &= e_1^o - k_1\times e_o^o = v_1 - k_1\times v_o\\
&\cdots\cdots\\
e_{10}^1 &= e_{10}^o - k_1\times e_{-9}^o = v_{10} - k_1\times v_9\\
&\cdots\cdots\\
e_{-9}^1 &= e_{-9}^o - k_1\times e_{10}^o = v_9 - k_1\times v_{10}
\end{aligned}\right\}\quad(3)$$

As a result, the contents of A-Reg and B-Reg become such as shown in FIG. 3(*b*).

During the process, $e_2^0$ is produced as output from A-Reg and at the timing at which $e_1^0$ is produced from B-Reg, the input to the switch $S_3$ is as follows;

$$e_0^0-k_1\times e_1^0=e_2^1$$

Also, the input to the switch $S_4$ becomes a signal $$e_0^0-k_1\times e_1^0=e_0^1$$

which is by one timing before $(e_1^0-k_1\times e_1^0)$ due to the delay circuit 5.

At this timing, the switches $S_3$ and $S_4$ are turned on to attain $x=e_2^1$ and $y=e_0^1$, and the PARCOR coefficient $k_2$ can be obtained in the same way as $k_1$. When $e_{10}^1$ is stored in A-Reg and $e_{-8}^1$ in B-Reg, the switch $S_5$ is turned on whereby $k_2$ is transferred to the register $R_0$ to prepare for the operation to obtain $k_3$.

In the same way, at the timing when $e_3^1$ is produced from A-Reg and $e_{-1}^1$ from B-Reg, the input of the switch $S_3$ becomes $e_3^2$ and that of the switch $S_4$ becomes $e_0^2$ which is by one timing earlier than $e_{-1}^2$. At this timing the switches $S_3$ and $S_4$ are turned on to attain $x=e_3^2$ and $y=e_0^2$ and the PARCOR coefficient $k_3$ can now be obtained.

The operation is continued while retarding the turn-on timing of the switch $S_3$ and $S_4$ by one data till $k_{10}$ (or $k_p$, generally) is computed.

Figure 4:
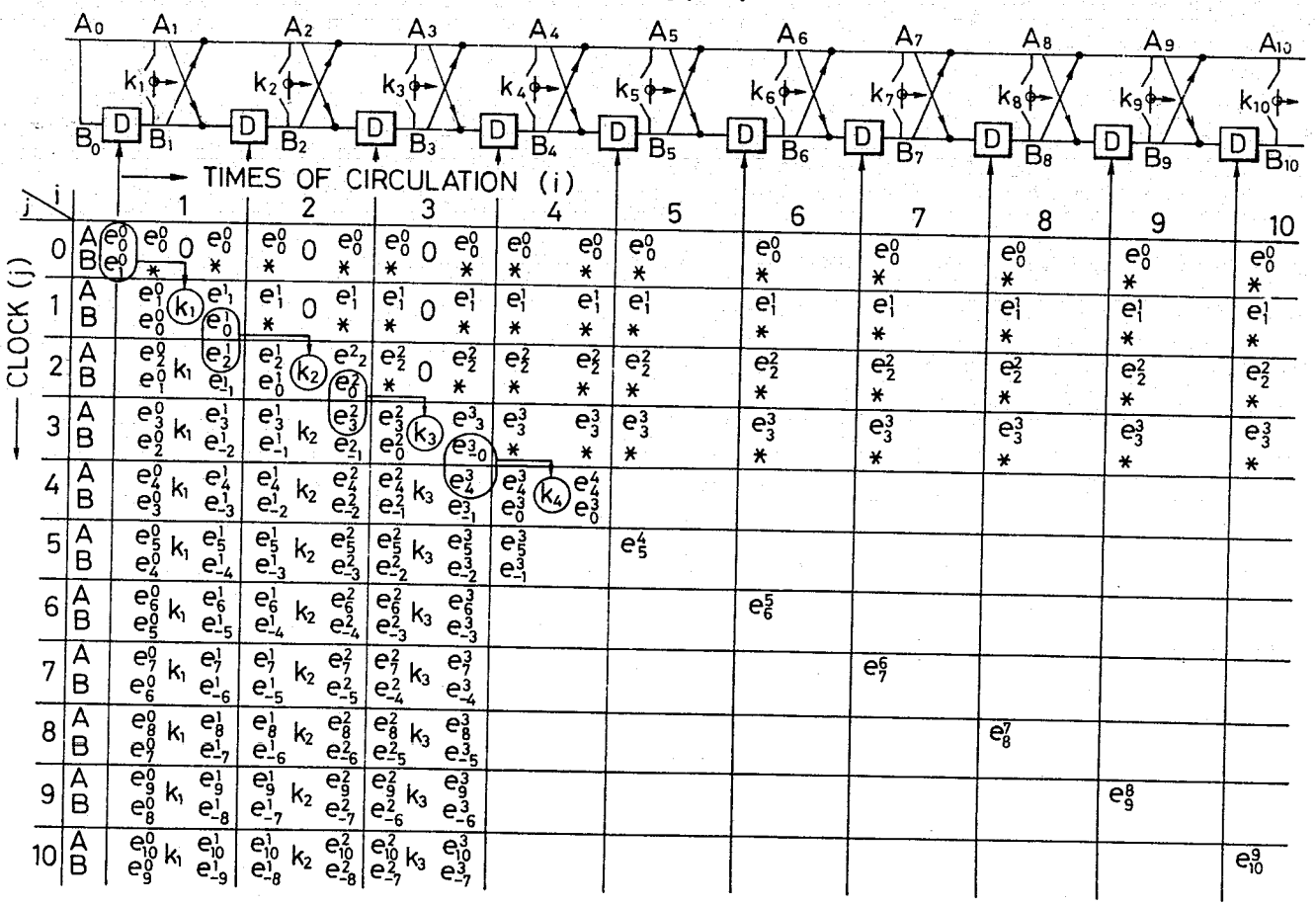
FIG. 4 is a diagram showing the change in signals appearing at the outputs of the A and B registers of FIG. 2 at every clock timing.

FIG. 4 illustrates signal changes of the output portions of A-Reg and B-Reg when the PARCOR coefficients $k_1$, $k_2$, . . . , $k_{10}$ are sequentially obtained.

The abscissa represents the number of circulation times (i) of the circulation processing in which the data pass through the digital filter 16 of FIG. 2, the operation of the equation (2) is effected and its result is stored in the registers 6 and 7. At the same time, the timings, at which the digital filter 16 is repeatedly used and the coefficients $k_1$, $k_2$, . . . , $k_{10}$ are obtained, are illustrated by an exploded view. The ordinate represents the number of transfer clocks when the data are transferred in A-Reg and B-Reg during each circulation processing.

To take an example of the step where $i=3$ and $j=3$ in FIG. 4, $e_3^2$ and $e_0^2$ on the left side of the column represent the signals that are output of the adder 4-1 and delay circuit 5 and appear at the output of A- and B-Regs through them in FIG. 2, while $e_3^3$ and $e_{-0}^3$ on the right side of the column are calculated as the output of the adders 4-1 and 4-2 of FIG. 2 in the following manner;

$$e_3^3=e_3^2-k_3\times e_0^2$$

$$e_{-0}^3=e_0^2-k_3\times e_3^2$$

The PARCOR coefficients $k_i$ $(i=1, 2, 3, \ldots)$ are sequentially obtained using the result of the computation of the preceeding steps as represented by arrows. If $i>j$, the data disappear one by one due to the delay circuit 5 whenever the data are repeatedly circulated and hence, do not represent correct values. However, there occurs no problem because $e_i^{i-1}$ and $e_0^{i-1}$ necessary for obtaining $k_i$ are correct values.

In the abovementioned operation, since the digitizer 12 is actuated before $k_i$ of the subsequent stage is obtained, the quantization error can be incorporated in the subsequent stage and compensated for in the stage of high order. Hence, the accuracy of analysis as a whole can be improved.

In the ordinary lattice method and modified lattice method, the circuit for obtaining $\tan h^{-1}k$ from x and y is processed in the waveshape range. Hence, the circuit requires 4 adders and 2 each squarers and accumulators. By contrast, the present invention can be constructed in an extremely simple manner using only two adders 8 and 9.

In the foregoing description, two sets each of the multipliers 3-1, 3-2 and the adders 4-1, 4-2 are required to form the digital filter 16. However, it is possible to use one each multiplier and adder on the time-sharing basis.

Figure 5:
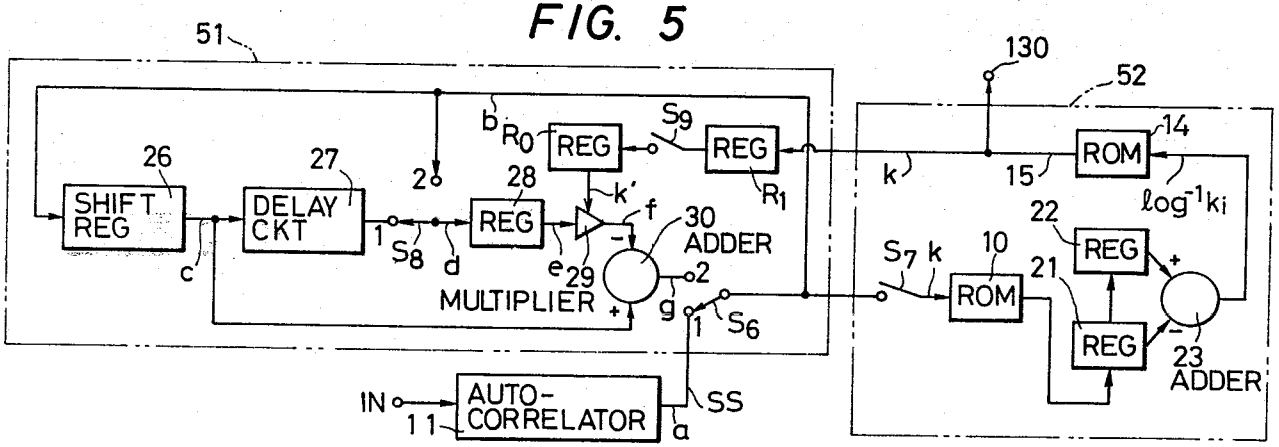
FIG. 5 is a diagram showing the circuit construction of the second embodiment of speech analysing device of the present invention.

FIG. 5 shows a circuit diagram of the second embodiment of the present invention.

In FIG. 5, the switches $S_6$ and $S_8$ are connected to the terminal 1 and the auto-correlation coefficient sequence SS ($v_0, v_1, \ldots, v_p$) is computed by the auto-correlator 11 from input speech signals IN to be analyzed in the same was as in FIG. 2.

The auto-correlation coefficient sequence SS is assumed to be produced in the sequence of the equation (4) or (5) by referring to equation (1);

$$v_0, v_1, \ldots, v_{p-1}, v_1, v_2, \ldots, v_p \quad (4)$$

$$v_1, v_2, \ldots, v_p, v_0, v_1, \ldots, v_{p-1} \quad (5)$$

For the sake of simplicity, the case of the equation (5) will be discussed here. The case of the equation (4) can also be processed in the same way by changing the timings for the switches as will be described next.

From the equation (1), the equation (5) can be regarded as the following data sequence of 2p;

$$e_1^0, e_2^0, \ldots e_p^0, e_{-0}^0, e_{-1}^0, e_{-2}^0, \ldots e_{-(p-1)}^0 \quad (6)$$

The auto-correlation coefficient sequence SS expressed by the equation (6) is divided into three parts and sent to the switch $S_7$ in the PARCOR coefficient computation portion 51, to the switch $S_8$ in the circulation processing portion 52 and to a shift register 26 (consisting of 2p words). The switch $S_7$ at the input portion of the PARCOR coefficient computation portion 52 is turned on at the timing at which $e_1^0$ and $e_{-0}^0$ appear. The contents written logarithmically in a ROM 10 are read out twice using $e_1^0$ and $e_{-0}^0$ as the addresses and the results are sequentially stored in registers 21 and 22. The difference between the read results are computed by an adder 23, and a ROM 14 storing the inverse logarithm of the result is read twice to obtain the PARCOR coefficient $k_1$.

That is to say, $$k_1 = \log^{-1}(\log e_1^o - \log e_{-o}^o) = \log^{-1}\left(\log \frac{e_1^o}{e_{-o}^o}\right) = \frac{e_1^o}{e_{-o}^o}$$

Generally, the switch $S_7$ is turned on at the timing when $e_1^{i-1}$ and $e_0^{i-1}$ appear, and the PARCOR coefficient $k_i$ is obtained as $$k_i = \log^{-1}(\log e_i^{i-1} - \log e_o^{i-1}) = \log^{-1}\left(\log \frac{e_i^{i-1}}{e_o^{i-1}}\right) = \frac{e_1^{i-1}}{e_o^{i-1}}$$

This can be taken out from the output terminal 130.

In the PARCOR coefficient computation portion 52, on the other hand, the ROM 10 is read out twice and the calculation to obtain the difference is made by the adder 13 to obtain the difference. Further, the ROM 14 is read once, thus yielding 4-bit delay $q=4$.

The PARCOR coefficient 15 obtained in the PARCOR coefficient computation portion 52 is sent to the data circulation processing portion 32 and is first stored in the register $R_1$. On the other hand, the data sequence of the equation (6) are sequentially stored in the shift register 26 from the side of the terminal 1 of the switch $S_6$. When $e_1^0, e_2^0, \ldots, e_p^0$ are stored, the switch $S_8$ is connected to the side of the terminal 2 and subsequent data sequence $e_{-0}^0, e_{-1}^0, \ldots, e_{-(p-1)}^0$ are also stored in the register 28.

The switch $S_9$ is turned on at a timing which is by one data belated than the timing of the appearance of $e_{-0}^0$ (generally, $e_{-0}^i$) and $k_1$ stored in the register $R_1$ is transferred to the register $R_0$. Generally, whenever the processing to be later described makes one circulation, the timing may further be retarded by one data. This is because the first result of the data applied to the multiplier 29 is not used.

When $k_1$ is obtained at the output of the register $R_0$, the output of the register 28 is $e_{-1}^0$ which is next to $e_{-0}^0$. Accordingly, the output of the multiplier 29 is $k_1 \times e_{-1}^0$ and is applied to one (−side) of the adder 30. The delay by the multiplier 29 can be made $r=l/2-1$ where l is the data length of the shorter data of the two to be multiplied.

Accordingly, in order to adjust the timing so that $e_2^0$ is obtained at the output of the register 26 when $k_1 \times e_{-1}^0$ is obtained at the output of the register 29, the following relation may be satisfied;

$$q+r=p-1 \quad (7)$$

where q is the delay of the register 28. The output of the adder 30 at this time is $$e_2^0 - k_1 \times e_{-1}^0 = e_2^1$$

and the result of the equation (2) can thus be obtained.

In the PARCOR analysis, the correlation data is usually 12 to 16-bit while the PARCOR coefficient is 3 to 12-bit. Hence, it is possible to obtain $r=5$ if $l=12$.

At the timing when $e_2^1$ is obtained at the output of the adder 30, the switch $S_6$ is connected to the terminal 2 and the switch $S_7$ is turned on whereby $\log(e_2^1)$ is read out from the ROM 10 and stored in the register 21. Further, the switch $S_8$ is connected to the terminal 1 and the switch $S_6$ is kept connected to the terminal 2 until all the PARCOR coefficients are obtained. Accordingly, the output of the shift register 26 is applied to the register 28 through the delay circuit 27 for the one-data delay.

In the same way as $e_2^1, e_3^1, e_4^1, \ldots, e_p^1, e_{-0}^1, e_{-1}^1, \ldots, e_{-(p-1)}^1$ are obtained at the output of the adder 30 is accordance with $e_j^1 = e_j^0 - k_1 \times e_{1-j}^0$ of the equation (2), and are sequentially stored in the shift register 26.

At the timing when $e_{-0}^1$ is obtained at the output of the adder 30, the switch $S_7$ is turned on and $\log(e_{-0}^1)$ is set from the ROM 10 to the register 21. In the same way as $k_1$, $k_2$ is obtained at the timing by q data later than the turn-on of the switch $S_7$ and is then stored in the register $R_1$. At this timing the switch $S_8$ is connected to the terminal 2. At the timing when $e_{-1}^1$, which is by one timing later than $e_{-0}^1$, appears at the output of the register 28 while it is further belated by q data, the switch $S_9$ is turned on and $k_2$ is transferred from the register $R_1$ to $R_0$. When $k_2 \times e_{-1}^1$ is obtained at the output of the multiplier 29 at the timing retarded by r data, the output of the adder becomes as follows since the output of the shift register 26 is $e_2^1$.

$$e_2^1 - k_2 \times e_{-1}^1 = e_2^2$$

There is thus obtained the result of the equation (2).

In the same way as $e_2^2, e_3^2, e_4^2, \ldots, e_p^2, e_{-0}^2, e_{-1}^2, \ldots e_{-(p-1)}^2$ are obtained at the output of the adder 30 in accordance with $e_j^2 = e_j^1 - k_2 \times e_{1-j}^1$ of the equation (2) and are sequentially stored in the shift register 26.

Thereafter, the operation is continued till $k_p$ is obtained by alternately changing over the switch $S_8$ between the terminals 1 and 2 at every p timing so as to circulate the data p times.

In the case of this embodiment (p=10), the delay of the PARCOR coefficient computation portion 52 is 4. In order to apply $k_1$ to the multiplier 29 at the practically necessary timing, it is convenient to make the register $R_0$ the same as $R_1$. For, under the condition p=10, $k_i$ would be retarded by one clock than the initially necessary timing at the multiplier 29 if $k_i$ has to pass through the two registers $R_0$ and $R_1$ at one each timing. If p>10, it is preferred to use the separate registers $R_0$ and $R_1$ in order not to erase $k_i$ obtained at the PARCOR coefficient computation portion 52 and $k_{i-1}$ which is being used at the multiplier 29.

If the PARCOR coefficient computation portion in this embodiment performs the operation in which k is first converted to $\tan h^{-1}k$ and $\tan h^{-1}k$ is quantized and is again returned to k in the same way as in the first embodiment, the delay q in the PARCOR coefficient computation portion becomes great. When q+r>p−1, the processing at the data circulation processing portion 51 may be stopped by the following timing.

$$\tau = q + r - (p-1)$$

in order to adjust the timing.

Generally, the total stop time($\tau \times p$) till $k_p$ is obtained is negligibly smaller in comparison with the time length of the speech to be analyzed. Hence, the abovementioned operation may be carried out without any practical problem.

On the contrary, when the adder 29 is reduced in size and r becomes smaller as expressed by the following relation;

$$q + r < p - 1$$

the operation by the PARCOR coefficient computation portion 52 may be stopped by the following clock;

$$-\tau = (p-1) - (q+r)$$

The foregoing explains the case where the autocorrelation coefficience sequence is given by the equation (5). When it is given by the equation (4), the turn-on timing of the switch $S_7$ is so changed as to obtain predetermined data and the polarity of the input to the adder 23 is reversed.

FIG. 6 illustrates the flow of signals at the portions (a, b, c, d, e, f, g, h, k, k') of FIG. 5 at every timing (T).

This is the case where p=10, q=4 and r=5. The data are circulated at every T=0∼19 and the switch $S_8$ is alternately connected to the terminals 1 and 2 at every p=10 timing.

Values in parentheses represent the operation that is not necessary for the subsequent computation. By utilizing this characteristics, $k_i$ can be obtained and the processing can be made even if the first data (represented by *) appearing at k' as the input to the multiplier 29 is not in time for the timing of the operation of the equation (2).

As represented in the column h, the turn-on timing of the switch $S_7$ is T=0 and T=10 between $e_1^0$ and $e_{-0}^0$ to obtain $k_1$ and has a gap of 10 timings. Between $e_2^1$ and $e_{-2}^1$ to obtain $k_2$, however, it is T=1 and T=10 and the gap becomes 9 timings. Similarly, the gap between $e_{i+1}^i$ and $e_0^i$ to obtain $k_i$ becomes smaller by one timing each whenever the data make one circulation.

As explained in the foregoing paragraph, the present invention makes it possible to realize the algorithm proposed by J. Le Roux through an extremely simplified hardware construction.

What is claimed is:

1. A speech analysing device comprising a correlator for obtaining an auto-correlation coefficient sequence of input speech signals, a computation portion for obtaining a partial auto-correlation coefficient sequence of said input speech signals, and a data circulation portion coupled to both said correlator and said computation portion to receive as its input said auto-correlation coefficient sequence and said partial auto-correlation coefficient sequence, wherein an output of said data circulation portion is coupled to an input of said computation portion so that output signals of said data circulation portion are employed as input signals to said computation portion for obtaining said partial auto-correlation sequence.

2. The speech analysing device as defined in claim 1 wherein said data circulation portion comprises;

two independent shift registers;

a digital filter using either one of two output signals from said shift registers and said partial auto-correlation coefficient sequence from said computation portion as its input signals; and two switching circuits for selecting two output signals from said digital filter at predetermined timings, respectively;

said two output signals from said digital filter being fed back to the corresponding input of said shift registers, respectively;

said output signals of said two switching circuits being used as the input signals to said computation portion for obtaining said partial auto-correlation coefficient sequence.

3. The speech analysing device as defined in claim 1 wherein said data circulation portion comprises;

an addition circuit;

a first switching circuit for selecting either said auto-correlation coefficient sequence from said correlator or output signals from said addition circuit;

a first shift register for storing the output signal from said first switching circuit;

a second switching circuit for selecting either the output signal of said first shift register or that of said first switching circuit at a predetermined timing;

a second shift register for storing the output of said second switching circuit;

a third shift register for storing the output signal of said partial auto-correlation coefficient computation portion receiving the output signal of said first switching circuit as its input signal; and a multiplier for multiplying a signal corresponding to the output of said third register and the output signal of said second register;

the output signal of said multiplier and that of said first register being applied as input signals to said addition circuit.

* * * * *